US005930572A

United States Patent [19]

Haneda et al.

[11] Patent Number: 5,930,572

[45] Date of Patent: Jul. 27, 1999

[54] APPARATUS FOR FORMING IMAGES ON BOTH SIDES OF SHEET

[75] Inventors: Satoshi Haneda; Kunio Shigeta, both of Hachioji, Japan

[73] Assignee: Konica Corporation, Tokyo, Japan

[21] Appl. No.: 09/108,940

[22] Filed: Jul. 1, 1998

[30] Foreign Application Priority Data

| | | | |
|---|---|---|---|
| Jul. 7, 1997 | [JP] | Japan | 9-181105 |
| Jul. 17, 1997 | [JP] | Japan | 9-192494 |
| Dec. 22, 1997 | [JP] | Japan | 9-353060 |

[51] Int. Cl.[6] ..... G03G 15/16

[52] U.S. Cl. ..... 399/309; 399/44; 399/45

[58] Field of Search ..... 399/309, 308, 399/302, 312, 44, 45, 66

[56] References Cited

U.S. PATENT DOCUMENTS

| | | | |
|---|---|---|---|
| 4,714,939 | 12/1987 | Ahern et al. | 355/3 |
| 5,797,077 | 8/1998 | Samizo et al. | 399/309 |
| 5,799,226 | 8/1998 | Shigeta et al. | 399/66 |

*Primary Examiner*—Arthur T. Grimley
*Assistant Examiner*—Greg Moldafsky
*Attorney, Agent, or Firm*—Frishauf, Holtz, Goodman, Langer & Chick, P.C.

[57] ABSTRACT

An apparatus for forming a toner image on a sheet, comprises first and second process units each comprising a photoreceptor, a charging device, an imagewise exposing device, and a developing device. The first process unit forms a first toner image on its photoreceptor and the second process unit forms a second toner image on its photoreceptor. A rotatable intermediate transfer member has a toner image receiving surface, and the first and second process units are located in close proximity to the toner image receiving surface of the rotatable intermediate transfer member. A second transfer device transfers the second toner image from the second process unit to the toner image receiving surface. A sheet feeder feeds the sheet to the toner image receiving surface so that the second side of the sheet is provided with the second toner image; and a first transfer device transfers the first toner image from the first process unit to the first side of the sheet on the toner image receiving surface.

13 Claims, 8 Drawing Sheets

APPARATUS FOR FORMING IMAGES ON BOTH SIDES OF SHEET

BACKGROUND OF THE INVENTION

The present invention relates to an electro-photographic type double-sided image forming apparatus such as a copying machine, printer and FAX, in which a toner image formed on an image forming body is transferred onto both sides of the recording sheet for fixing.

Heretofore, in a double-sided copy, an image on one side formed on an image forming body is transferred onto a recording sheet for fixing. The aforesaid recording sheet is temporarily housed in a double-sided reversal paper feeding device. The aforesaid recording sheet is re-fed from the double-sided reversal paper feeding device synchronously with an image formed on the image forming body for transferring an image on the other side onto the recording sheet for fixing.

In the aforesaid double-sided copying device, as described above, conveyance of the recording sheet is conducted such as feeding of a paper to the double-sided reversal paper feeding device and double passage to the fixing device. Therefore, reliability on conveyance of the recording sheet is reduced, causing jamming. As described above, the above-mentioned image forming apparatus in which images are formed on both sides using the double-sided reversal paper feeding device requires much time for copying since the conveyance distance of the recording sheet is lengthened. In addition, since the recording sheet receives heat twice for fixing, paper quality is damaged. To the contrary, technologies to fix images with one passage after forming toner images on both sides of the recording sheet are disclosed in Japanese Tokkousho Nos. 37538/1974 and 28740/1979 and Japanese Tokkaihei 1-44457 and 4-214576.

In the above-mentioned double-sided image forming apparatus, toner images provided on both sides of recording sheet are simultaneously fixed due to heating by the fixing device once only. Therefore, there is no possibility to hurt paper quality of the recording sheet and copying speed can be increased by shortening the conveyance path of the recording sheet.

However, in this apparatus, the toner image formed by an image forming means is transferred to an intermediate transfer body. A next image is formed after one rotation of the intermediate transfer body. Therefore the image forming means needs waiting time to form the next image, and this waiting time remained as the cause decreasing the copying speed.

The present inventors further continued reduction of copying speed. An objective of the present invention is to realize an image forming apparatus capable of extremely increasing copying speed. Further, another objective of the present invention is to provide an image forming apparatus capable of forming images on one side additionally to the aforesaid functions and to provide an image forming apparatus capable of conducting treatment when the image forming unit does not serve for image forming.

SUMMARY OF THE INVENTION

The present invention can be attained by the following constitutions.

An apparatus for forming a toner image on a sheet, comprises:

a first process unit comprising a photoreceptor, a charging device, an imagewise exposing device, and a developing device, whereby the first process unit forms a first toner image on the photoreceptor, a rotatable intermediate transfer member having a toner image receiving surface, wherein the first process unit is located in close proximity to the toner image receiving surface of the rotatable intermediate transfer member;

a second process unit comprising a photoreceptor, a charging device, an imagewise exposing device, and a developing device, whereby the second process unit forms a second toner image on the photoreceptor, wherein the second process unit is located in close proximity to the toner image receiving surface;

a second transfer device for transferring the second toner image from the second process unit to the toner image receiving surface;

a sheet feeder for feeding the sheet to the toner image receiving surface so that the second side of the sheet is provided with the second toner image; and a first transfer device for transferring the first toner image from the first process unit to the first side of the sheet on the toner image receiving surface.

DETAILED DESCRIPTION OF THE PREFERRED EMBODIMENT

Figure 1:
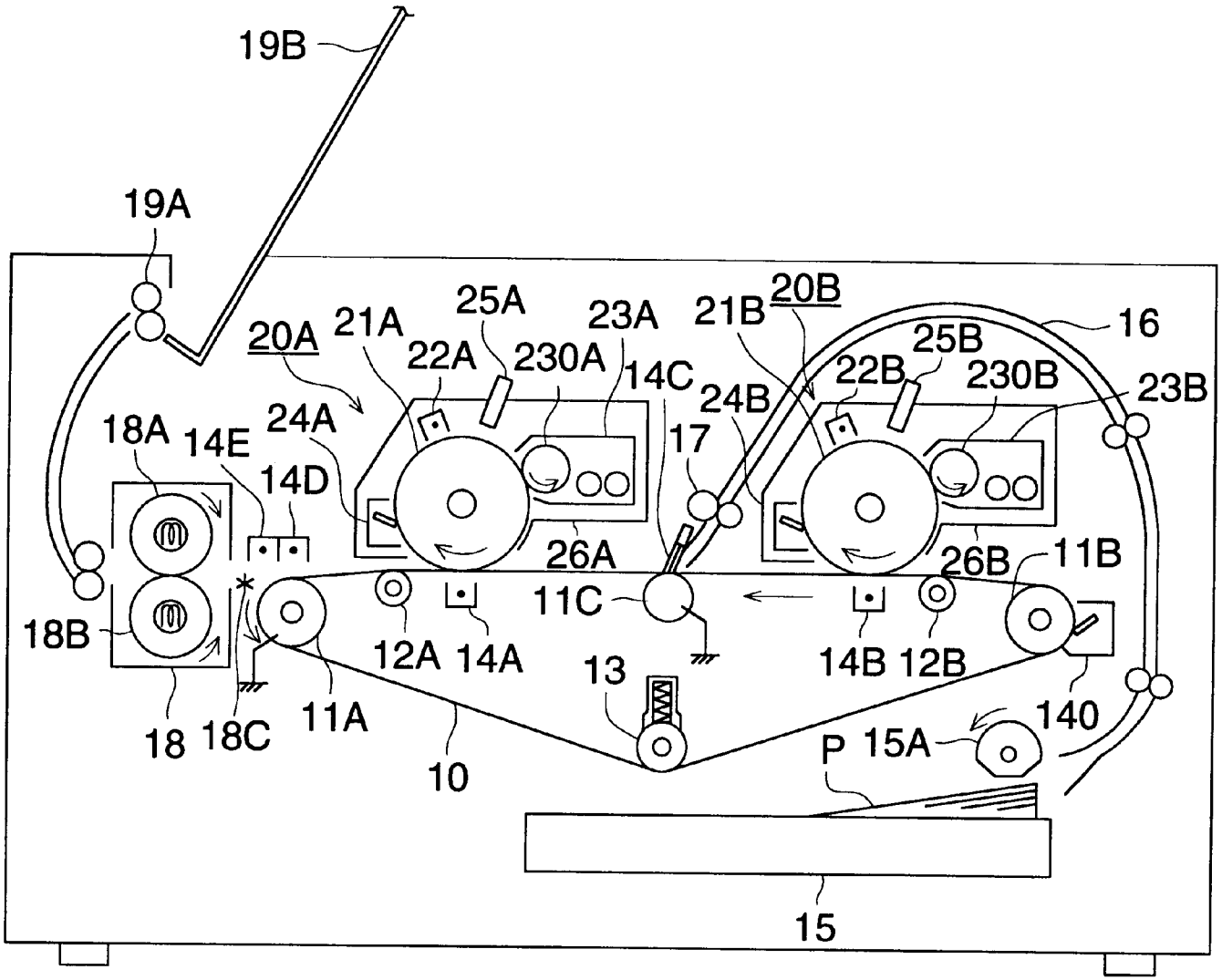
FIG. 1 shows a cross sectional block diagram of an image forming apparatus of the present invention.

First, an image forming process of an embodiment of the present invention and each mechanism thereof will be explained using FIGS. 1 through 3. FIG. 1 is a cross sectional block diagram of an image forming apparatus showing one embodiment of the image forming apparatus of the present invention.

Intermediate transfer body 10, which is the third image carrier means, is an endless belt capable of retaining a toner image on the circumference thereof. For example, aforesaid intermediate transfer body is composed of two layers, i.e., a semi-conductive fluorine layer whose thickness is 5–50 $\mu$m employed as a toner filming prevention layer, at the outside of a semi-conductive rubber belt composed of a silicone rubber or an urethane rubber whose thickness is 0.5–2.0 mm and volume resistance ratio is $10^8$–$10^{14}\Omega\cdot$cm. In place of a rubber belt substrate, a semi-conductive polyester, polystyrene, polyethylene terephthalate, polyimide, denatured polyimide and ETFE (ethylene-tetrafluoroethylene copolymer) whose thickness is 0.1–0.5 mm and a volume resistance ratio is $10^8$–$10^{14}\Omega\cdot$cm can also be used.

Aforesaid intermediate transfer body 10 is bridged horizontally by means of driving roller 11A, tension roller 13, driven roller 11B, guiding roller 12B, driven roller 11C and guiding roller 12A. By means of power transferred to driving roller 11A, aforesaid intermediate transfer body 10 is circulated, conveyed and rotated counter-clockwise.

Above rotating intermediate transfer body 10, first processing unit 20A and second processing unit 20B are horizontally located. Aforesaid first processing unit 20A and second processing unit 20B are respectively composed of photoreceptor drum 21 which is an image carrier means for carrying a toner image and toner image forming means 26 which forms a toner image on photoreceptor drum 21. The processing units 20 form a toner image on photoreceptor drum 21 by means of conventional electrophotographic processes. As described in detail later, first processing unit 20A has the same constitution as second processing unit 20B except for the controlling procedure. If the contents are the same in first processing unit 20A and second processing unit 20B, same numerals are used except for the addition of letters "A" and "B". Processing units 20 are located in such a manner that the circumference of each photoreceptor drum 21 provides a prescribed contact pressure on intermediate transfer body 10 from above the apparatus main body. Incidentally, toner image forming means 26 is composed of scorotron charger 22 (a charging means), exposure unit 25 (an exposure means), developing device 23 (a developing means) and cleaning device 24 (a cleaning means).

Photoreceptor drums 21A and 21B (the first and the second image carrier means) are composed of organic photosensitive layers (OPC) on the outer surface of the grounded aluminum substrate whose outer diameter is 30–80 mm. Due to power provided by the apparatus main body, aforesaid photoreceptor drums are driven and rotated at the same rate as the above-mentioned intermediate transfer body 10.

Scorotron charger 22 comprises of a saw toothed electrode or a corona discharge electrode including a wire electrode and a control grid which is kept at a prescribed potential to the above-mentioned organic photoreceptor layer on photoreceptor drum 10. Aforesaid scorotron charger 22 is mounted close to photoreceptor drum 21, in which aforesaid scorotron charger 22 faces photoreceptor drum 21 in a direction perpendicular to the movement of photoreceptor drum 21. Scorotron charger 22 conducts corona discharge at the same polarity as the toner (in the present embodiment, a negative charge) for providing uniform potential to photoreceptor drum 21.

Exposure unit 25 comprises a bar-shaped exposure element into which plural units of LED (light emission diode) as an image exposure light emission element arranged in the primary scanning direction parallel to the shaft of photoreceptor drum 21 are arranged in an array shape and a Selfoc lens as a life size image forming element. As an exposure element, bar-shaped type in which plural emission elements such as FL (fluorescent luminescence), EL (electroluminescence) and PL (plasma discharge) are used. The exposure unit conducts image exposure on photoreceptor drum 21 based on image data stored in the memory read by an image reading device provided separately so that a latent image is formed on aforesaid photoreceptor drum 21.

Developing device 23 is provided with developing sleeve 230 formed with cylindrical non-magnetic stainless steel or aluminum whose thickness is 0.5–1 mm and whose outer diameter is 10–30 mm and houses one-component or two-component developer inside thereof. Developing sleeve 230 is rotated in the same direction as the rotation of photoreceptor drum 21. By impressing D.C. voltage with the same polarity as the toner (in the present embodiment, a negative polarity) or developing bias in which A.C. voltage is added to D.C. voltage, reversal development is conducted on the exposure portion of photoreceptor drum 21 under contact condition or non-contact condition.

Transfer device 14A (the first transfer means) and transfer device 14B (the second transfer means) provide charge with an opposite polarity as the toner on the rear surface of the above-mentioned intermediate transfer body 10 for forming the transfer region of the toner image between two photoreceptor drums 21. Each transfer device is located facing the circumference of respective photoreceptor drum 21. Transfer device 14A transfers toner image on photoreceptor drum 21A onto the upper surface (the front surface) of recording paper P which is a fed recording sheet, and in addition, transfer device 14B transfers the toner image on photoreceptor drum 21B onto intermediate transfer body 10.

Paper charger 14C, which is a recording sheet charging means, is a brush-shaped charger. It is located between first processing unit 20A and second processing unit 20B. It is located facing the circumference of grounded driven roller 11C. It is capable of adhering/separating to/from intermediate transfer body 10. When recording paper P is conveyed to intermediate transfer body 10, fed recording paper P is charged to the same polarity as the toner. Charged recording paper P is conveyed to the transfer region formed with photoreceptor drum 21A through the toner image or after directly adsorbing the toner image transferred by transfer device 14B. Incidentally, paper charger 14C may also be a corona charger.

Transfer device 14D, which is the third transfer means, transfers the toner image onto intermediate transfer body 10 on the under surface (rear surface) of recording paper P by providing charge having the opposite polarity as the toner on the top surface (the front surface) of recording paper P on intermediate transfer body 10. It is located facing the circumference of grounded driving roller 11A.

Neutralizer 14E, a separation means, functions to neutralize separated recording paper P onto which the toner image has been transferred on both surfaces due to discharging for separating aforesaid recording paper P from the circumference of intermediate transfer body 10. Aforesaid and faces circumference of driving roller 11A grounded. However, it may be possible to omit the neutralizer 14E.

Fixing device 18, which is a fixing means, comprises a thermal roller type fixing device including a first roller 18A having a heater inside thereof and a second roller 18B having a heater inside thereof. By sandwiching and conveying recording paper P separated from intermediate transfer body 10 by means of neutralizer 14E, toner image transferred on both surfaces is simultaneously heated and pressed for fixing.

Next, the process of aforesaid image forming apparatus will be explained. When image data are inputted from an image reading device (not illustrated) or a personal computer, aforesaid image data are subjected to image processing detailed later. Then, aforesaid image data are temporarily housed in the memory. Corresponding to the image forming process, image data for the front surface and that on the rear surface are processed in a mirror relationship, and successively outputted to exposure units 25A and 25B.

First, image data for the rear surface is inputted onto exposure unit 25B of second processing unit 20B. In aforesaid second processing unit 20B (the second toner image forming means 26B), due to operation of scorotron charger 22B, exposure unit 25B and developing device 23B, the rear surface toner image is formed based on the rear surface image data on the circumference of photoreceptor drum 21B (which is the second image carrier means). Aforesaid toner image charges the rear surface of intermediate transfer body 10 by means of transfer device 14B, which is the second transfer means, and the image is temporarily transferred onto the circumference of intermediate transfer body 10.

Parallel to forming rear surface toner image and transferring, recording paper P is started to be fed from paper feeding cassette 15 by means of operation of conveyance-out roller 15A. Recording paper P is fed to timing roller 17 through paper feeding path 16.

A prescribed time after inputting rear surface image data, front surface image data is inputted into exposure unit 25A of first processing unit 20A. In aforesaid processing unit 20A (the first toner image forming means 26A), due to operation of scorotron charger 22A, exposure unit 25A and developing device 23A, the front surface toner image is formed on the circumference of photoreceptor drum 21A (which is the first image carrier means).

Synchronizing with the formation of the front surface toner image on the circumference of photoreceptor drum 21A in first processing unit 20A and the position of the rear surface toner image transferred onto intermediate transfer body 10, operation of timing roller 17 starts. Recording paper P is fed onto intermediate transfer body 10 through rear surface toner image on intermediate transfer body 10 in such a manner that the end position of the front and rear toner images coincide with the end position of recording paper P.

At this time, recording paper P is adsorbed onto intermediate transfer body 10 through toner image on intermediate transfer body 10 due to charging by paper charger 14C, and is conveyed integrally with intermediate transfer body 10. By means of transfer device 14A, which is the first transfer means, the rear surface of intermediate transfer body 10 is also charged. The surface toner image carried by photoreceptor drum 21A of first processing unit 20A is transferred onto the upper surface (the first surface) of conveyed recording paper P. Next, due to transfer device 14D, which is the third transfer means, the surface of recording paper P is charged. The toner image for the rear surface on intermediate transfer body 10 transferred by means of photoreceptor drum 21B of second processing unit 20B is re-transferred onto the lower surface (the second surface) of recording paper P.

Due to discharging by means of neutralizer 14E, recording paper P on which toner image has been transferred onto both surfaces as described above is neutralized so that it separates from the circumference of intermediate transfer body 10. Recording paper P is conveyed to fixing device 18 through spur member 18C which guides the lower surface of recording paper P. At fixing device 18, toner image is fused, and then the recording paper is discharged to tray 19B through paper discharging roller 19A. If curve separation is utilized, neutralizer 14E can be omitted. On the other hand, from photoreceptor drum 21 and intermediate transfer body 10 from which transfer of the toner image has been finished, residual toner is removed and cleaned by means of cleaning device 24 and 140 provided respectively to prepare for successive formation and transfer of successive toner images.

As described above, in an image forming device of the embodiment of the present invention, a toner image is formed on photoreceptor drums 21A and 21B independently by means of toner image forming means 26A and 26B. The toner image formed on photoreceptor drum 21B is temporarily transferred onto intermediate transfer body 10. Following this, the toner images on intermediate transfer body 10 are transferred onto both surfaces of recording paper P and simultaneously fixed. Therefore, image forming speed can be noticeably increased. Specifically, since toner images on both surfaces are formed with minute time interval and transfer of the toner image on both surfaces of recording paper P, the time necessary for recording images on both surfaces can noticeably be shortened.

With regard to the paper feeding system of recording paper P, a housing section, i.e., the above-mentioned paper feeding cassette 15 is located below intermediate transfer body 10 which is located in the lower portion of the apparatus main body. Recording paper P is conveyed through paper feeding path 16 formed primarily around second processing unit 20B.

As a result, recording paper P is smoothly fed upstream of first processing unit 20A. By means of paper charger 14C, aforesaid recording paper P contacts intermediate transfer body 10 to be conveyed. In FIG. 2, due to the form, the above-mentioned paper feeding path 16 easily accepts the sheet of recording paper fed from manual feeding section 40 provided in the upper portion the apparatus main body. Therefore, paper feeding from both paths is possible. Manual feeding section 40 provided in the upper portion of the apparatus has a short paper path. Therefore, it is suitable for feeding of thick paper.

Since the specifications of the above-mentioned processing units 20A and 20B are common in terms of the function of their image forming, maintenance of them is relatively easy. In addition, they are located parallelly in a horizontal direction above intermediate transfer body 10, it is possible to constitute them in such a manner as to be able to detach easily from the top of the apparatus main body.

Namely, above the apparatus main body, open/close lid 50A is located corresponding to the above-mentioned first processing unit 20A and open/close lid 50B integral with the above-mentioned paper feeding path 16 is located corresponding to the above-mentioned second processing unit 20B. Aforesaid lids rotate clockwise on shafts HA and HB as a fulcrum so that they are opened to an angle exhibited by the dotted line.

Due to the above-mentioned opening of each open/close lid, each processing unit moves up along the guide members (not illustrated) obliquely so that it is possible to be removed from the apparatus main body. Due to this, maintenance such as replacements and removal of jammed paper can be conducted easily.

Another embodiment will now be explained referring to FIG. 3. Incidentally, items common to FIG. 1 will be provided with identical numerals and their explanation will be omitted.

The above-mentioned image forming apparatus is provided with paper feeding stand 70, which functions as a paper feeding means, located on the side of the apparatus main body which comes under the upstream side of the above-mentioned second processing unit 20B on intermediate transfer body 10.

The above-mentioned paper feeding stand 70 is used for feeding paper for image formation onto the surface of recording sheet including a base paper which is difficult to be fed from the above-mentioned paper feeding cassette 15 through paper feeding path 16. By means of timing roller 17A, the recording sheet crosses section 16A in paper feeding path. Aforesaid sheet is fed onto the circumference of intermediate transfer body 10. By means of paper charger 14C provided so as to face driven roller 11B, the transfer sheet is conveyed while being contacted to intermediate transfer body 10.

In each of the above-mentioned processing units, it is also possible to form a toner image by superposing two toner images having different colors, such as a black toner image and a red toner image. Namely, initially, in second processing unit 20B, for example, formation of a red toner image is started. In synchronizing with this, the above-mentioned timing roller 17A starts feeding the recording sheet.

The red toner image on photoreceptor drum 21B is transferred onto the upper surface of a fed recording sheet by means of transfer device 14B.

Next, in first processing unit 20A, in synchronizing the conveyance position of a recording sheet, for example, formation of a black toner image starts. On the recording sheet, the black toner image on photoreceptor drum 21A is superposed on the red toner image transferred onto the recording sheet in advance. Incidentally, in such cases, paper charger 14C is moved to the position shown by a dashed line so that contact with the recording sheet can be avoided.

As described above, the recording sheet on which images have been synthesized by superposing two toner images on one surface is conveyed to fixing device 18 after being separated from intermediate transfer body 10 by means of neutralizer 14E through transfer device 14D in which charging has been stopped.

Each of the above-mentioned developing devices 23 can be replaced with developing devices housing specific color toner in accordance with the color of the image to be synthesized. They can be ejected easily to the outside of the apparatus.

On each processing unit 20, the upper surface corresponding to developing device 23 of each unit is defined to be open/close lid 23A. The upper surface, of the apparatus main body, corresponding to each open/close lid 23A is composed of open/close lid 60A and open/close lid 60B which are connected by means of part 16A in paper feeding path 16. With shafts HA or HB acting as fulcrums, by opening each lid up to the angle shown by a dashed line, housed developing devices 23 can easily be detached to be replaced without moving the units.

As described above, in this image forming apparatus, formation of images on both surfaces is possible due to synthesis with forming images on both surfaces.

Figure 4:
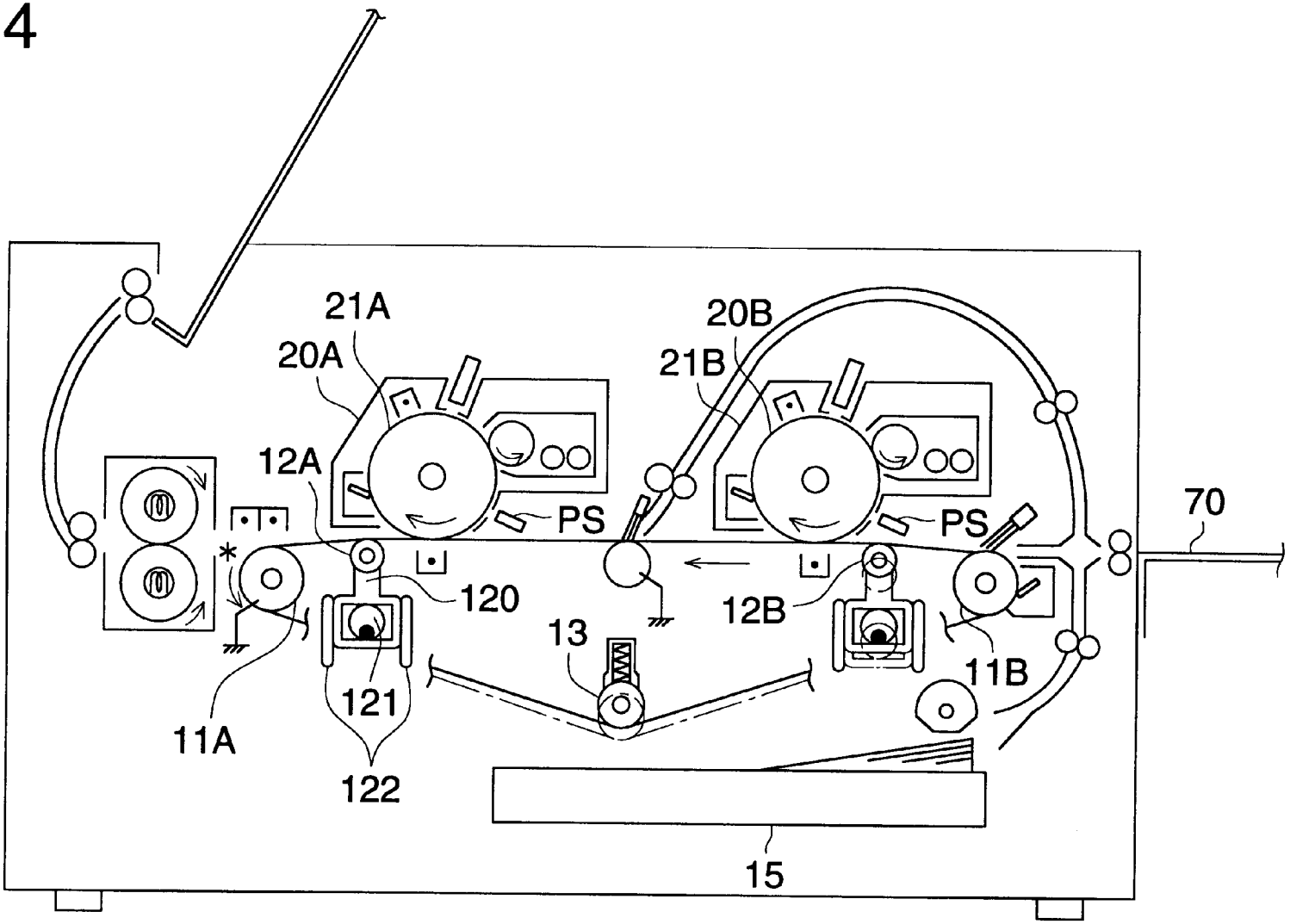
FIG. 4 shows a schematic drawing of an image forming apparatus.
Figure 5:
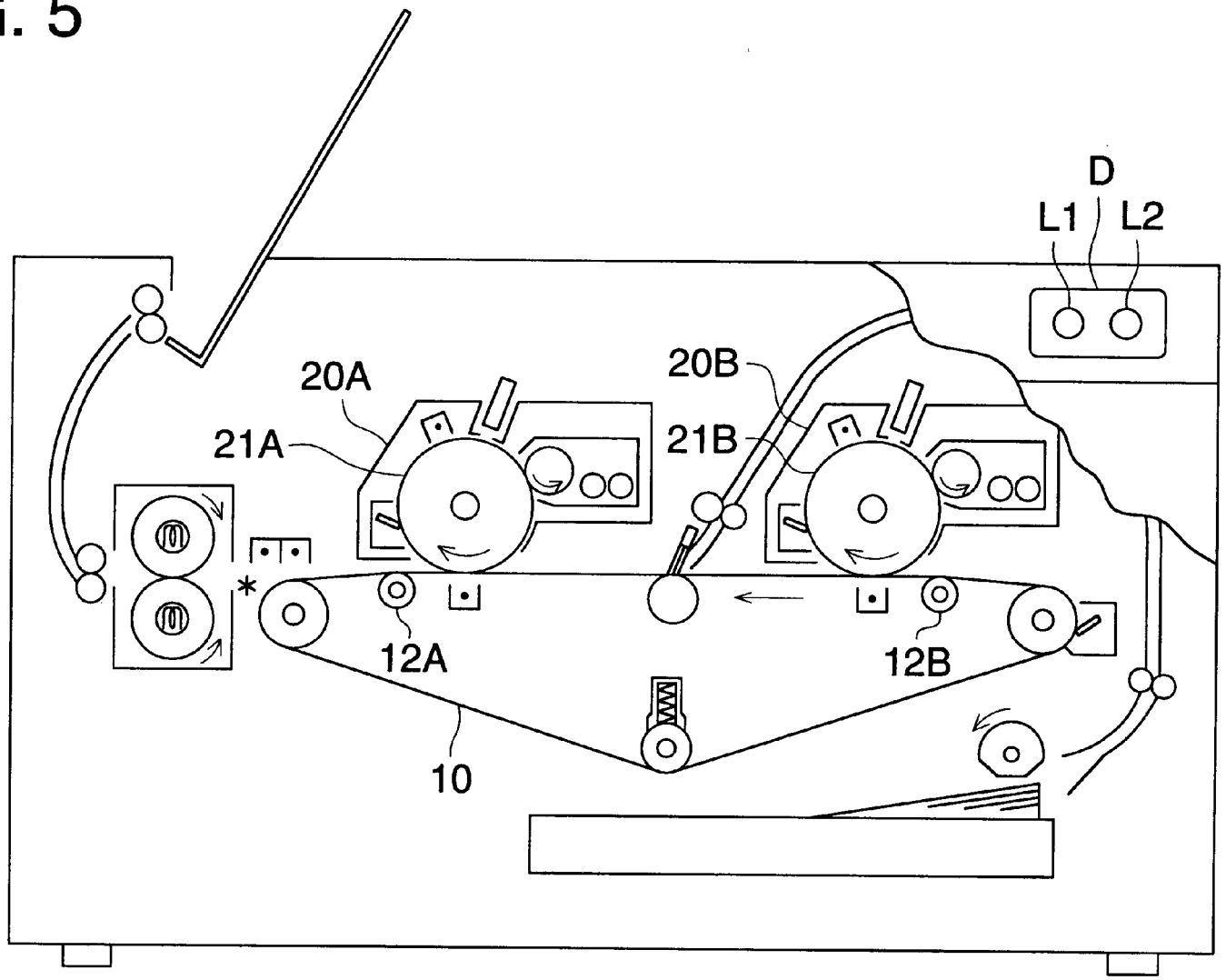
FIG. 5 shows a display section of an image forming apparatus.
Figure 6:
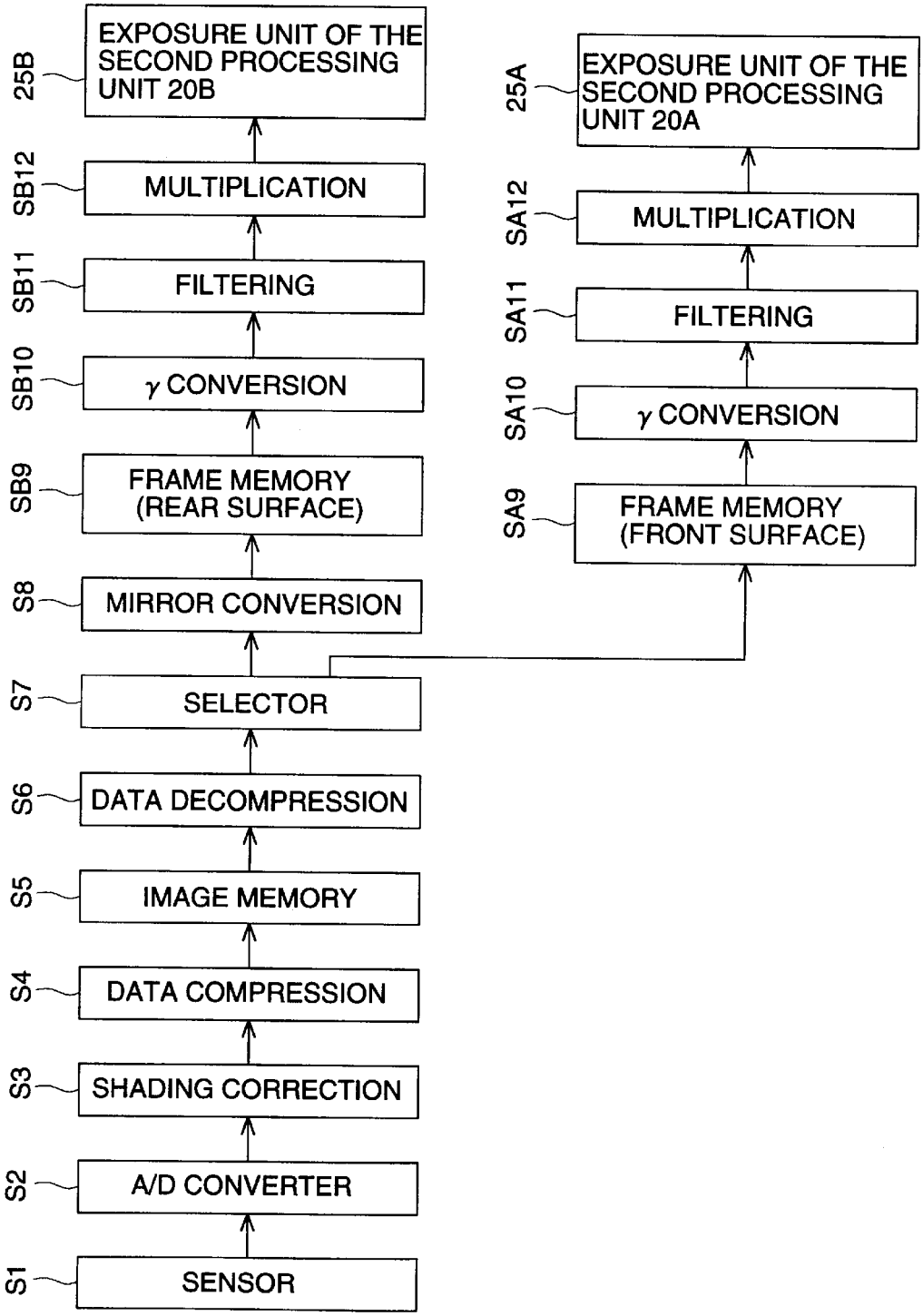
FIG. 6 is a drawing showing one example of a digital image processing system.
Figure 7:
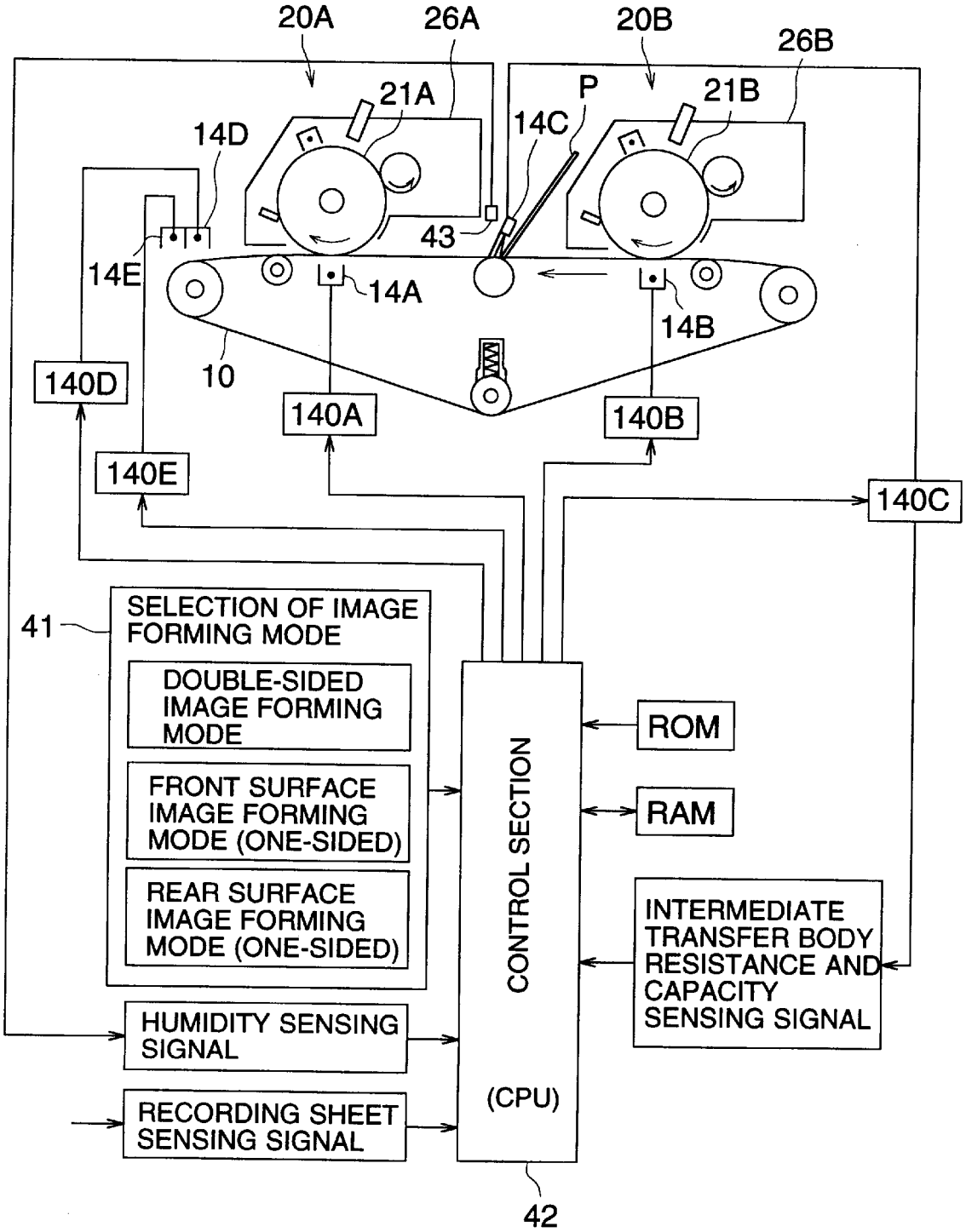
FIG. 7 shows a conceptual drawing of a control block.
Figure 8:
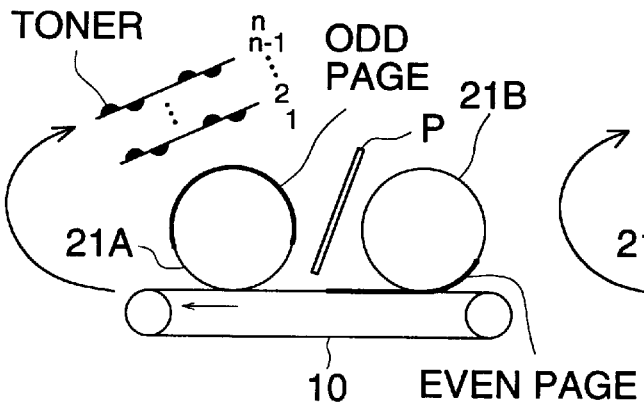
FIGS. 8(*a*) to 8(*d*) are drawings showing schematically the status of paper discharging of a recording sheet on which images are formed.
Figure 8:
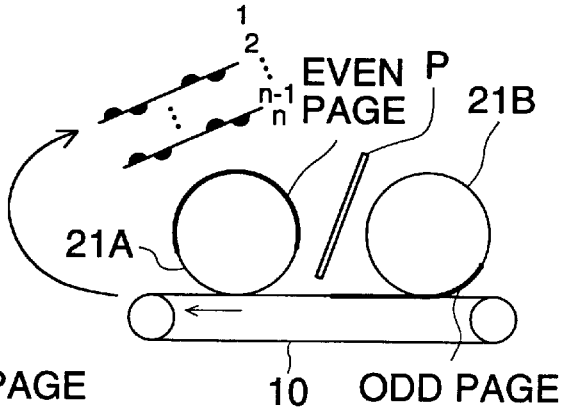
Figure 8:
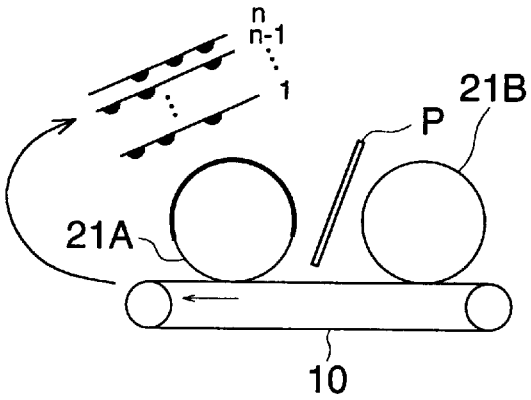
Figure 8:
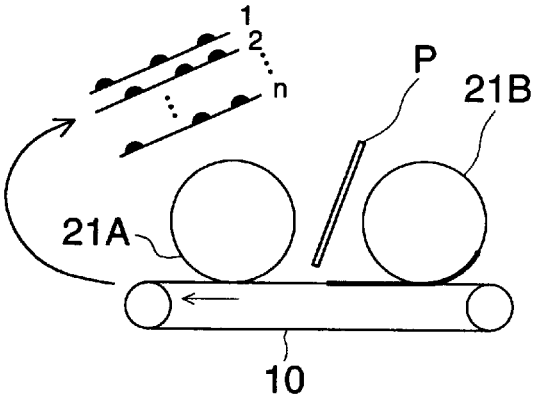

As indicated in FIGS. 4 and 5, the above-mentioned guide rollers 12A and 12B which contact the upper surface of the circumference of intermediate transfer body 10 linearly are supported rotatably by paired frame member 120 respectively on both shafts. Due to half rotation of eccentric cam 121 which is engaged with the frame portion, aforesaid guide rollers are lowered vertically at a prescribed amount.

The above-mentioned image forming apparatus can select either a double-sided image forming mode or a single-sided image forming mode by manual or by means of controlling at the control section. If the double-sided image forming mode, both guide rollers occupy upper portion illustrated by a solid line. If the single-sided image forming mode which conducts direct transferring onto the surface of the recording sheet is chosen, only guiding roller 12B drags due to the rotation of the above-mentioned eccentric roller 121. Incidentally, as a power source for eccentric cam 121, a rotary solenoid is employed.

Due to lowering of the above-mentioned guide roller 12B, the circumference of the intermediate transfer body facing processing unit 20B is separated from the circumference of photoreceptor drum 21B. Connection of the power system (not illustrated) which is transferred to photoreceptor drum 21B is also canceled. Therefore, only display lamp L1 showing stand-by of first processing unit 20A is lit on display section D on the outside of the apparatus as shown in FIG. 5.

Slackness of intermediate transfer body 10 following lowering of guiding roller 12B is automatically taken up due to biasing of the above-mentioned tension roller 13. Intermediate transfer body 10 keeps extension status. Formation of the toner image at the transfer region in processing unit 20A and circulation conveyance by intermediate transfer body 10 continue without hindrance.

When either processing unit becomes inoperative, it is so constituted that the above-mentioned image forming apparatus automatically switches to the other unit.

If the single-sided image forming mode onto the rear surface of a recording sheet by means of twice transfer is designated, only guiding roller 12A is lowered due to rotation of eccentric roller 121. The circumference of intermediate transfer body 10 which faces processing unit 20A is separated from the circumference of photoreceptor drum 21A. Simultaneously, rotation of photoreceptor drum 21A stops. In this occasion, only display lamp L2 is lit. The toner image formed on photoreceptor drum 21B is temporarily transferred onto intermediate transfer body 10. By means of transfer device 14D, toner image on intermediate transfer body 10 is transferred onto the rear surface of the recording sheet, aforesaid sheet is then separated and fixed.

When an image forming method in which a paper is fed from paper feeding stand 70 and toner image of two colors is superposed on the surface of the recording sheet, processing unit 20A or 20B is caused to be not operated by lowered guiding roller 12A or 12B. Thereby, it is possible to modify the system to a mode to form a black-color or a red-color monochrome image from a mode in which black and red color images are superposed.

On the circumference of photoreceptor drum 21 in each processing unit 20, photo-sensor PS is mounted. If a toner image is not sensed on the circumference of photoreceptor drum 21 at a prescribed point of time, due to a signal from the photo-sensor PS, a rotary solenoid operates so that guiding roller 12A or 12B is lowered.

As a result, the circumference of intermediate transfer body 10 facing processing unit 20A or 20B is separated from the circumference of photoreceptor drum 21A or 21B. At the same time, connection of the power system (not illustrated) transferred to each of photoreceptor drums 21A and 21B. Display lamp L1 or L2 on display section D is deactivated so that switching to the single-sided image forming mode is noticed.

If the display lamp L1 is deactivated when processing unit 20A becomes inoperable, feeding of recording paper P from paper feeding cassette 15 automatically stops, and only manual paper feeding from horizontal paper feeding stand 70 becomes possible. Thereby, switching of functions is conducted in such a manner that image transfer for a single-sided image by means of processing unit 20A becomes possible.

Next, an embodiment related to image forming conditions of FIGS. 6 through 9 will be explained. When an image is formed on both surfaces of recording paper P, it is preferable to differentiate the transfer conditions of transfer devices 14A, 14B and 14D. This is because that if toner images are transferred by means of each transfer device 14A, 14B and 14D, recording paper and a toner image intervening between the transferred toner image and the transfer devices are different. Accordingly, in the present embodiment, the transfer conditions most suitable for each transfer device 14A, 14B or 14D are stored in a storing means (which will be explained later). When an image is formed on both surfaces of the above-mentioned recording paper P, the optional transfer conditions for each transfer device 14A, 14B or 14D are read out from the storing means. Based on the aforesaid conditions, power supply 140A, 140B or 140D (see FIG. 7) which feeds transfer electric current to each transfer device or which impresses a transfer voltage. Due to this, favorable double-sided images can be formed.

Further in detail, when transferring by means of transfer device 14A, the transfer electrical field is weakened compared with transfer by means of transfer device 14B, due to recording paper P and toner images on the rear surface. Therefore, the absolute value of the transfer electrical current or transfer voltage which are transfer conditions of transfer device 14B is set larger than the absolute value of transfer electrical current or transfer voltage which are transfer conditions of transfer device 14A. In addition, in transferring by transfer device 14D, it is necessary that charge (charge due to transfer devices 14A and 14B) on the rear surface of intermediate transfer body 10 is removed and that the toner image on the surface of recording paper P is subjected to polarity-conversion. Accordingly, the absolute value of transfer electrical current or transfer voltage which are transfer conditions of transfer device 14D is set higher than the absolute value of the transfer electrical current or the transfer voltage which are transfer conditions of transfer device 14A.

Incidentally, in the above-mentioned double-sided image formation, if an image is formed by first toner image forming means 26A and second toner image forming means 26B under the same control (process) conditions, (front surface) image can be formed by first processing unit 20A with one rotation onto the surface of recording paper P from photoreceptor drum 21A. On the contrary, in the case of (rear surface) image formation by means of second processing unit 20B, twice transfer, i.e., transfer from photoreceptor drum 21B to intermediate transfer body 10 and transfer from intermediate transfer body 10 to the rear surface of recording paper P is conducted. Therefore, image density of the rear surface image formed by second processing unit 20B is reduced, since the transfer ratio during transferring is not 100%, thereby reducing the toner adhesion amount.

In order to solve the above-mentioned problem, in the present embodiment, the process conditions of first toner image forming means 26A is different from those of second toner image forming means 26B. Here, "process conditions" include charge, exposure and development conditions. Further in detail process conditions, charge potential of photoreceptor drum 21, exposure amount (exposure strength or exposure time), development bias or rotation speed of development sleeves 230A and 230B. As described above, first processing unit 20A and second processing unit 20B are constituted as the same processing units for attaining reduction of cost. Simultaneously, the most suitable image formation is realized on the front surface and the rear surface by differentiating process conditions whose modification is easy. Specifically, toner adhesion amount is reduced for image formation on the rear surface, toner amount adhered on photoreceptor drum 21B is differentiated in such a manner that it is larger than the toner amount adhered on photoreceptor drum 21*a* (when the same image is formed).

For example, charge conditions are modified in such a manner that the absolute value of electrical current or voltage impressed on a corona discharge electrode or a control grid of scorotron charger 22B is set larger than the absolute value of the electrical current or voltage impressed on the corona discharge electrode or the control grid of scorotron charger 22A. Illuminance strength or pulse width of the exposure unit is modified in such a manner that the exposure amount from exposure unit 25B corresponding to the maximum density of the image is set larger than the exposure amount from exposure unit 25A corresponding to the maximum density of the image is set larger. The absolute value or the A.C. voltage of bias voltage impressed onto development sleeve 230B is set larger than the absolute value or the A.C. voltage of bias voltage impressed onto development sleeve 230A. Rotation rate of development sleeve 230B is set larger than the rotation rate of development sleeve 230A.

Figure 2:
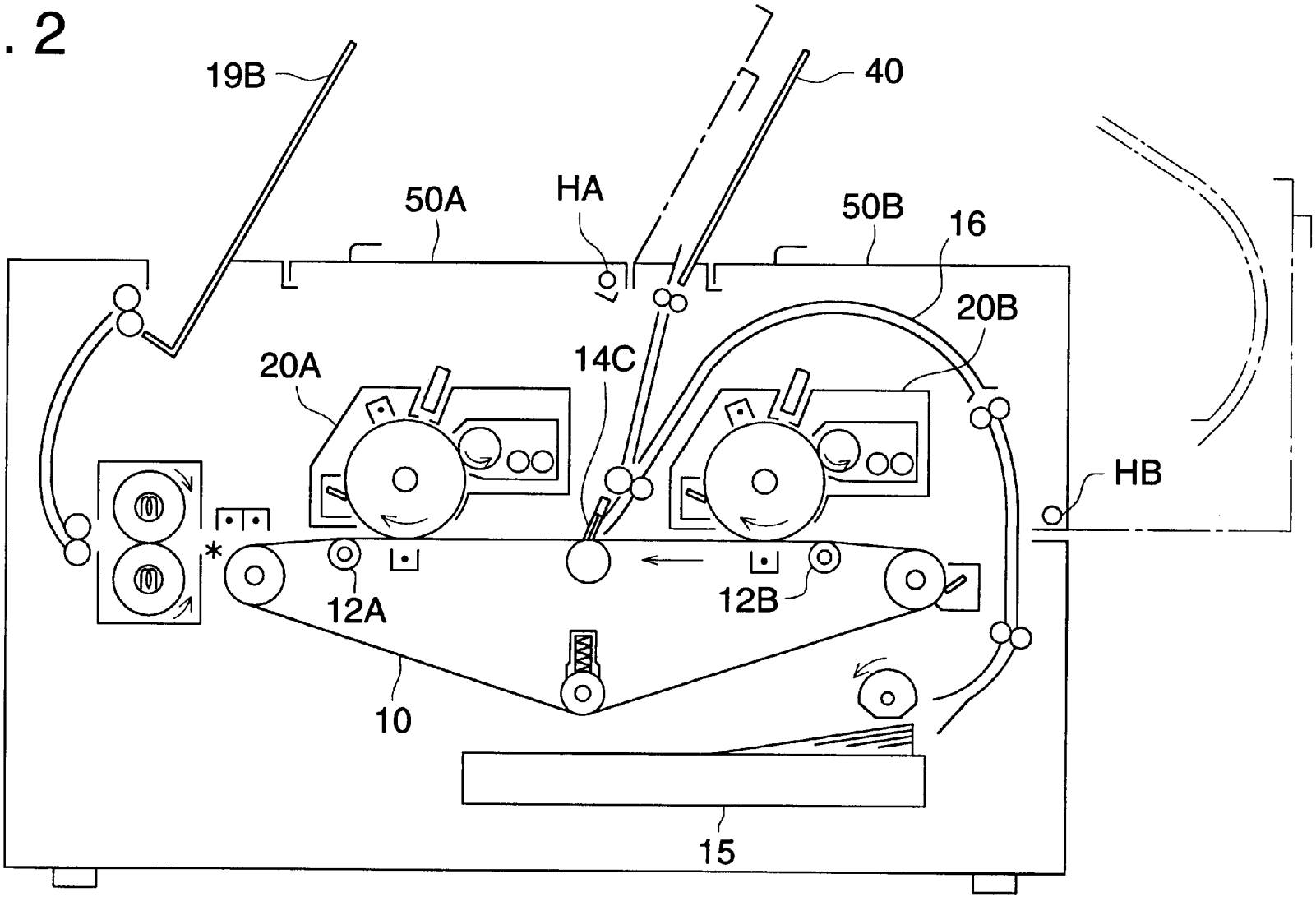
FIG. 2 shows a schematic drawing of an image forming apparatus.
Figure 3:
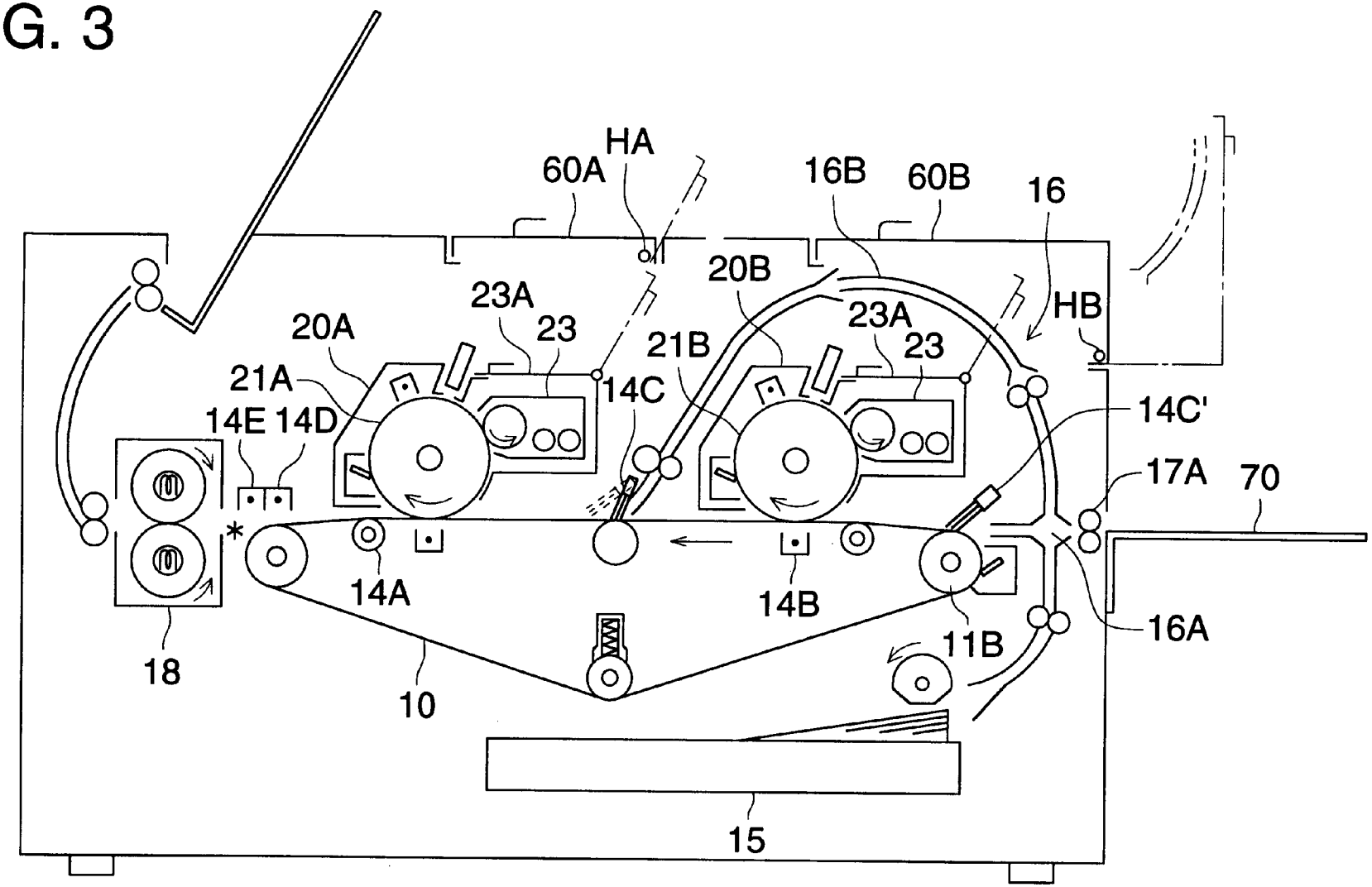
FIG. 3 shows a schematic drawing of an image forming apparatus.

Incidentally, in an image forming apparatus of the present embodiment, if an original image is copied (image formation), as shown in FIG. 2 which exhibits one example of a digital image processing system, the original image is read by a sensor such as a scanner (S1). After read image information is subjected to A/D conversion (S2), the image signal is subjected to shading correction (S3) and data compression (S4), and then stored in an image memory (S5). Incidentally, an image is formed by the use of signals from a computer, aforesaid signals are converted to bit map data from a font computer, and then inputted into the image memory (S5). Next, image data read from the image memory successively in accordance with an outputting order are subjected to data recovery processing (S6). Then, by means of the selector (S7), aforesaid image data are separated into image data to be formed in second processing unit 20B, i.e., image data for the image on the rear surface and image data to be formed in first processing unit 20A, i.e., image data for the image on the front surface. The image data for the image on the front surface are accumulated in the frame memory as it is (SA9). However, image data for the image on the rear surface are subjected to mirror processing in which left and right of the image data are reversed (S8) and then accumulated in the frame memory (SB9). Each memory (SA9 and SB9) posses memory for two faces. One of aforesaid two faces is used for developing the above-mentioned image data the other memory is used for outputting the image data alternately.

Image data from the frame memory (SA9) are outputted to first exposure unit 25A in first processing unit 20A through image processing in accordance with the surface image such as y conversion (SA10), filtering (SA11) and setting to multi-value (SA12). Simultaneous with this, image data from frame memory SB9 are outputted to second exposure unit 25B in second processing unit 20B through γ conversion (SB10), filtering (SB11) and setting to multi-value (SB12).

In an image forming apparatus of the present embodiment, it is preferable to change image processing conditions between when an image is formed on the front surface and when an image is formed on the rear surface, i.e., between image formation by the use of first processing unit 20A and image formation by the use of second processing unit 20B. In the present embodiment, image formation (on the rear surface) by means of second processing unit 20B requires double transferring. Therefore, there is a tendency that intermediate tones are damaged (γ is increased) so that lines becomes thicker. Accordingly, with regard to γ conversion, the degree of γ conversion for (the rear surface) image formation in second processing unit 20B is lowered (namely, using a relatively flat γ correction curve) (SB 10)

compared with the degree of γ conversion for (rear surface) image formation in second processing unit 20B (in other words, γ correction curve is differentiated between image formation on the front surface and that on the rear surface). In addition, with regard to filtering, which one of image processing factors, filtering for (rear surface) image formation in second processing unit 20B (SB11) is caused to be more critical compared with filtering for (front surface) image formation in first processing unit 20A (SA11) (The MTF filter is strengthened. Namely, the MTF filter to be used is differentiated between the front surface image formation and the rear surface image formation. It is preferable that the γ correction curve and the MTF filter are determined in advance (they are different when the front surface image formation and the rear surface image formation, and are set independently) so that it is adjusted that the front surface image and the rear surface image are reproduced at the same level on recording paper P.

In the image forming apparatus of the present embodiment, to differentiate image forming conditions such as the above-mentioned process condition and image processing condition is effective not only when images are formed but also when an image is formed either on the front surface or on the rear surface.

Now, image formation on one side of recording paper P in an image forming apparatus of the present embodiment will be explained.

When an image is formed only on the surface of recording paper P, if image data is inputted from an image reading device or a computer, aforesaid image data is subjected to the above-mentioned image processing. Aforesaid image data are temporarily stored in the memory, and then outputted to exposure unit 25A successively. In first processing unit 20A (first toner image forming means 26A), a toner image based on the image data is formed on the circumference of photoreceptor drum 21A due to an operation of charger 22A, exposure unit 25A and developing device 23A. On the other hand, in parallel to the formation of the toner image, feeding of recording paper P from paper feeding cassette 15 is started due to the operation of out-conveyance roller 15A. Recording paper P is fed to timing roller 17 through paper feeding path 16. Operation of timing roller 17 is started to synchronizing the formation of toner image on the circumference of photoreceptor drum 21A. Recording paper P is fed onto intermediate transfer body 10 in such a manner that the end position of the toner image and that of recording paper P coincide. Recording paper P is conveyed integrally with intermediate transfer body 10 due to charging by paper charger 14C. Toner image carried by photoreceptor drum 21A in first processing unit 20A is transferred onto the upper surface (the first surface) by transfer device 14A. Recording paper P on which the toner image has only been transferred onto only the front surface thereof is neutralized are neutralized. Aforesaid recording toner image is neutralize are conveyed to fixing device 18 through spur member 18C. Then, aforesaid recording paper P is discharged to neutralized due to discharging by neutralizer 14E. Recording paper P is conveyed to fixing device 18 through spur member 18C. In fixing device 18, toner image is diffused. Then, aforesaid recording paper P is discharged to tray 19B through paper discharging roller 19A.

Next, when an image is formed only on the rear surface of recording paper P, if image data are inputted from an image forming apparatus or a computer, the above-mentioned image processing (it goes without saying that low g correction and thin line processing). After that, aforesaid recording paper P is temporarily stored in the memory, and then, successively outputted to exposure unit 25B. In second processing unit 20B (second toner image forming means 26B), due to the effect of scorotron charger 22B, exposure unit 25B and developing device 23B, on the circumference of photoreceptor drum 21B, toner image based on image data is formed (it goes without saying that the process conditions are differentiated for each case). Aforesaid toner image is temporarily transferred onto the circumference of intermediate transfer body 10. On the other hand, in parallel to the forming and transferring of the toner image, feeding of recording paper P from paper feeding cassette 15 is started due to the operation of out-conveyance roller 15A. Recording paper P is fed to timing roller 17 through paper feeding path 16. In synchronizing the position of toner image transferred onto intermediate transfer body 10, operation of timing roller 17 is started. Recording paper P is fed onto intermediate transfer body 10 through the use of toner image on intermediate transfer body 10 in such a manner that the end position of the toner image and that of recording paper P coincide. Due to charging of paper charger 14C, recording paper P is conveyed integrally with intermediate transfer body 10. After recording paper P passed below first processing unit 20A, the toner image on intermediate transfer body 10 transferred from photoreceptor drum 21B in second processing unit 20B is transferred again onto the lower surface (second surface) due to transfer device 14D. Recording paper P on which toner image was transferred on the rear surface is neutralized due to discharge of neutralizer 14E. Aforesaid recording paper P is separated from the circumference of intermediate transfer body 10. Via spur member 18C, aforesaid recording paper P is conveyed to fixing device 18. At fixing device 18, the toner image is diffused. Then, through paper discharging roller 19A, aforesaid recording paper P is discharged to tray 19B.

As described above, in the image forming apparatus of the present embodiment, an image can be formed not only on both surfaces of recording paper P (this is referred to as the double-sided image forming mode). However, the aforesaid double-sided image forming mode includes two modes, one for the front surface and one for the rear surface of recording paper P (they are respectively referred to as the front surface image forming mode and the rear surface image forming mode).

In the aforesaid image forming apparatus, if transfer conditions by transfer device 14A and/or 14D are set to be the between when an image is formed on one side (either the first surface or the second surface) and when images are formed on both surfaces of recording paper P, due to whether or not there is a toner image, or due to existence of a toner image which has not been transferred, transfer of the toner image to be transferred is influenced, resulting in poor transfer and disturbance of toner image. In detail, at the position of transfer device 14A, when the double-sided image forming mode is used, the rear surface toner image exists between recording paper P and intermediate transfer body 10. However, in the case of the front surface image forming mode, the rear surface toner image does not exist. At the position of transfer device 14D, in the case of the double-sided image forming mode, the front surface toner image exists on the front surface of recording paper P. Contrary, in the case of the rear surface image forming mode, the front surface toner image does not exist. In the case of the double-sided image forming mode, toner image which cannot be transferred by each transfer device. Therefore, compared with the one-sided image forming mode (either the front surface image forming mode or the rear surface image forming mode), transfer electrical field is weakened. If the transfer conditions are the same in any mode, poor transfer occurs.

In the present embodiment, in order to solve aforesaid problem, transfer conditions of transfer device 14A and/or 14D are different when an image is formed on one surface of recording paper P and when an image is formed on both surface of recording paper P. This will now be explained based on FIG. 3 which is a concept drawing of a control block. By means of image forming mode selection button 41 provided on an operation panel (not illustrated), one mode is selected from the double-sided image forming mode (as described later, aforesaid double-sided image forming mode includes two modes, however, here they are regarded as one mode), the front surface image forming mode and the rear surface image forming mode. Incidentally, aforesaid selection can be selected from attached equipment such as a computer. When the mode is selected, control section (CPU) 42 conducts image formation controlling the image forming apparatus, based on the sequence (the above-mentioned process) stored in ROM or RAM which are storing means, in accordance with the selected mode. In this instance, in the storing means, the most suitable transfer conditions for transfer devices 14A and 14D calculated from a previous experiment has been stored. Based on aforesaid transfer conditions, control section 42 controls power supply 140A which supplies transfer electrical current or which impresses transfer voltage to transfer device 14A, and power supply 140D which supplies transfer electrical current or which impresses transfer voltage to transfer device 14D.

As described above, in the present embodiment, in order to differentiate transfer conditions of transfer devices 14A and 14D between the double-sided image forming mode and the single-sided image forming mode, at least two transfer conditions are stored for the double-sided image forming mode and the single-sided image forming mode transfer condition in accordance with the selection of image forming mode selection button 41 read from the storing means. Based on aforesaid transfer conditions, power supply 140A and 140D are adjusted. Due to this, by either mode, the double-sided image forming mode or the single-sided image forming mode, preferable transfer is conducted so that favorable image is formed.

Further in detail, it is preferable that the absolute values of the transfer electrical current or transfer voltage which are transfer conditions of transfer device 14A in the case of the front surface image forming mode (in which an image is formed only on the front surface of recording paper P) are smaller than those in the case of the double-sided image forming mode (when an image is formed on both surfaces of recording paper P). In addition, it is preferable that the absolute values of the transfer electrical current or transfer voltage which are transfer conditions of transfer device 14D in the case of the rear surface image forming mode (when an image is formed only on the rear surface of recording paper P) is smaller than those in the case of the double-sided image forming mode (when an image is formed on both surfaces of recording paper P). In other words, it is preferable that the absolute values of the transfer electrical current or transfer voltage which are transfer conditions in the case of the double surfaces image forming mode (when an image is formed only on both surface of recording paper P) is larger than those in the case of the single-sided image forming mode (when an image is formed on either surface of recording paper P).

The same theory, as that in which transfer conditions of the above-mentioned transfer devices 14A and 14D are differentiated between the double-sided image forming mode and the single-sided image forming mode, is applied to neutralizer 14E. In this occasion, if the neutralizing conditions by the neutralizer are the same between when images are formed on both surface or on the rear surface and when an image is formed on the surface thereof, the charge remaining on recording paper P is different and thereby the attracting force between recording paper P and intermediate transfer body 10 is different, depending upon whether or not there exists a toner image on the front surface or the rear surface of recording paper P, and whether discharging is by means of transfer device 14D. Due to this, the neutralizing property of recording paper P is unfavorably influenced so that separation is not conducted favorably.

Accordingly, in the present embodiment, the neutralizing conditions by neutralizer 14E is differentiated between when an image is formed only on the surface of recording paper P and when images are formed on both surfaces or only on the rear surface of recording paper P. Accordingly, in the present embodiment, the separation conditions stored in the storing means are read in accordance with selection by image forming mode selection button 41. Power supply 140E which supplies neutralizing electrical current or which impresses neutralizing voltage to neutralizer 14E based on aforesaid mechanism. Due to aforesaid mechanism, favorable separation can be conducted in either mode so that favorable image can be formed.

Further in detail, it is preferable that, in the case of the front surface image forming mode, the values of neutralizing electrical current or neutralizing voltage which are separation conditions of neutralizer 14E are lower than in the case of the rear surface image forming mode. On the other hand, it is preferable that, in the case of the rear surface image forming mode, the values of neutralizing electrical current or neutralizing voltage which are separation conditions of neutralizer 14E are equivalent or lower than in the case of the double-sided surface image forming mode.

The same theory, as that in which transfer conditions of the above-mentioned transfer devices 14A and 14D and separation conditions of neutralizer 14E are differentiated between the double-sided image forming mode and the single-sided image forming mode, is applied to paper charger 14C. In this occasion, if the charging conditions by paper charger 14C are the same between when images are formed on both surface or only on the rear surface and when an image is formed on the surface thereof, contacting property between recording paper P and intermediate transfer body 10 becomes different depending upon whether or not there exists a toner image on intermediate transfer body 10. Due to this, the neutralizing property of recording paper P is influenced so that separation is not conducted favorably.

Accordingly, in the present embodiment, the neutralizing conditions by paper charger 14C is differentiated between when an image is formed only on the front surface of recording paper P and when images are formed on both surfaces, or only on the rear surface of recording paper P. Accordingly, in the present embodiment, the charging conditions stored in the storing means are read in accordance with selection by image forming mode selection button 41. Power supply 140C which supplies neutralizing electrical current or which impresses neutralizing voltage to paper charger 14C based on aforesaid mechanism. Due to aforesaid mechanism, favorable separation can be conducted in either mode so that favorable image can be formed.

Further in detail, it is preferable that, in the case of the front surface image forming mode, the values of neutralizing electrical current or neutralizing voltage which are separation conditions of paper charger 14C are set lower than in the case of the rear surface image forming mode. On the other hand, it is preferable that, in the case of the rear surface image forming mode, the values of neutralizing electrical current or neutralizing voltage which are separation conditions of paper charger 14C is set equivalent or lower than in the case of the double-sided surface image forming mode.

Charging property, transferring property and separation property by means of the above-mentioned transfer devices 14A and 14D, neutralizer 14E, paper charger 14C and transfer device 14B is variable depending upon kind of recording paper P and change of ambient conditions (in addition, change and deterioration of intermediate transfer body 10 due to repeated usage). Accordingly, the present embodiment enables that favorable image forming can be realized, not adversely affected by aforesaid factors. Hereinafter, the mechanism therefor will be explained referring to FIG. 3.

Humidity sensing sensor 43 (not illustrated in FIG. 1) which senses humidity inside the image forming apparatus as an ambient conditions sensing means is located between processing units 20A and 20B, and is provided close to intermediate transfer body 10. Based on humidity sensing signals, information is inputted to control section 42. In the present embodiment, in order to sense the ambient conditions, humidity sensing sensor 43 is provided. In addition, a temperature sensor to measure temperature inside the image forming apparatus may be provided. Due to the temperature sensed, the ambient conditions may be sensed to include humidity.

With regard to the kind of recording paper P, a signal from a switch (for example, a thick paper switch which is pressed when recording paper P is a thick paper and an OHP switch which is pressed when an OHP is used) which is provided on an operation panel (not illustrated) and which selects the kind of recording paper P is inputted to control section 42 as a recording sheet sensing signal. A method for sensing the kind of recording paper P is not limited thereto. By sensing the resistance or capacity of recording paper P, the kind of recording paper P may also be sensed. For example, by the use of paper charger 14C, due to sensing welded electrical current value at the end portion of recording paper P, resistance and capacity of recording paper P can also be sensed. In this occasion, if the width of recording paper P is changed, the welded electrical current value is changed. Therefore, it is preferable that the resistance and the capacity of recording paper P are sensed referring to the information about the width of recording paper P.

In order to sense change and deterioration of intermediate transfer body 10 due to repeated use, in the present embodiment, paper charger 14C is used. Change or deterioration of intermediate transfer body 10 can be sensed by resistance or capacity of intermediate transfer body 10. When recording paper P does not pass above intermediate transfer body 10, the paper charger is brought into contact with intermediate transfer body 10 for impressing voltage and sensing the welded electrical current value. The resulting signal is inputted to control section 42 as a signal for sensing the resistance and the capacity of the intermediate transfer body.

In control section 42, depending upon aforesaid humidity sensing signal, the recording sheet sensing signal and the signal for sensing the resistance and capacity of intermediate transfer body transfer conditions of transfer devices 14A, 14B and 14D, neutralizing conditions of neutralizer 14E and charging conditions of paper charger 14C are read out from the storing means or are calculated. Based on aforesaid conditions, each factor is controlled. Due to this, the occurrence of the poor charging, transferring and separation is minimized so that favorable image forming is enabled. Namely, if humidity is increased, the charge property of recording paper P is deteriorated or the charge property of intermediate transfer body is deteriorated, influences thereby can be covered by increasing the absolute value of electrical current or voltage. In the present embodiment, control of each transfer condition of transfer devices 14A, 14B and 14D, neutralizing conditions of neutralizer 14E and charging conditions of paper charger 14C were conducted in accordance with the kind of recording paper P, ambient conditions and intermediate transfer body 10. However, not limiting thereto, they may be in accordance with at least one of aforesaid 3 factors.

In the present embodiment, at least two of transfer conditions of transfer devices 14A, 14B or 14D, neutralizing conditions of neutralizer 14E or charging conditions of paper charger 14C are synchronized to be modified. As described above, in the image forming apparatus of the present embodiment, depending upon the double-sided image forming mode, the front surface image forming mode, the rear surface image forming mode, or the driving (control) means are different respectively. By modifying at least two control means in which controlling is complicated, the most suitable conditions can easily be set. For example, if each control is independently conducted, each control is not independent, but are complicatedly related. Each of the most suitable set range of the control has a maximum value. Accordingly, there occur cases in which electrical current value is excessively increased or increase width of the electrical current value is lessened. Therefore, the most suitable conditions cannot be set in advance. Further, aforesaid control becomes extremely complicated.

The aforesaid control will now be detailed. It is preferable to conduct at least one of the following a)–i).

a) In the double-sided image forming mode, if the absolute value of the transfer electrical current or the transfer voltage which are the transfer conditions of transfer device 14B is increased, the absolute value of the transfer electrical current or the transfer voltage which are the transfer conditions of transfer device 14A is increased or the absolute value of the transfer electrical current or the transfer voltage which are the transfer conditions of transfer device 14D are increased. Due to this, favorable double-sided images can be formed.

b) In the double-sided image forming mode, if the absolute value of the transfer electrical current or the transfer voltage which are the transfer conditions of transfer device 14A is increased, the absolute value of the transfer electrical current or the transfer voltage which are the transfer conditions of transfer device 14D is increased or the value of the neutralization electrical current or the neutralization voltage which are the neutralization conditions of neutralizer 14E is also increased. Due to this, favorable double-sided images can be formed.

c) In the double-sided image forming mode, if the absolute value of the transfer electrical current or the transfer voltage, which are the transfer conditions of transfer device 14D, is increased, the value of the neutralization electrical current or the neutralization voltage, which are the neutralization conditions of neutralizer 14E, is also increased. Due to this, favorable double-sided images can be formed.

d) In the double-sided image forming mode, if the absolute value of the transfer electrical current or the transfer voltage, which are the transfer conditions of transfer device 14B is increased, the absolute value of the transfer electrical current or the transfer voltage, which are the transfer conditions of transfer device 14A is also increased then the absolute value of the transfer electrical current or the transfer voltage which are the transfer conditions of transfer device 14D is increased or the neutralization voltage which are the neutralization conditions of neutralizer 14E is also increased. Due to this, favorable double-sided image can be formed.

e) In the double-sided image forming mode, if the absolute value of the transfer electrical current or the transfer voltage which are the transfer conditions of transfer device 14A is increased, the value of the neutralization electrical current or the neutralization voltage, which are the neutralization conditions of neutralizer 14E, is also increased. Due to this, favorable double-sided image can be formed.

f) In the front surface image forming mode, if the absolute value of the transfer electrical current or the transfer voltage which are the transfer conditions of transfer device 14C is increased, the absolute value of the transfer electrical current or the transfer voltage, which are the transfer conditions of transfer device 14A is also increased or the value of the neutralization electrical current or the neutralization voltage, which are the neutralization conditions of neutralizer 14E is increased as well. Due to this, favorable double-sided image can be formed.

g) In the rear surface image forming mode, if the absolute value of the transfer electrical current or the transfer voltage, which are the transfer conditions of transfer device 14B, is increased, the absolute value of the transfer electrical current or the transfer voltage, which are the transfer conditions of transfer device 14D, is increased. Due to this, favorable double-sided image can be formed.

h) In the front surface image forming mode, if the absolute value of the transfer electrical current or the transfer voltage, which are the transfer conditions of transfer device 14D, is increased, the value of the neutralization electrical current or the neutralization voltage, which are the neutralization conditions of neutralizer 14E is also increased. Due to this, favorable double-sided image can be formed.

i) In the rear surface image forming mode, if the absolute value of the transfer electrical current or the transfer voltage which are the transfer conditions of transfer device 14C is increased, the absolute value of the transfer electrical current or the transfer voltage which are the transfer conditions of transfer device 14A is increased or the value of the neutralization electrical current or the neutralization voltage which are the neutralization conditions of neutralizer 14E is increased. Due to this, favorable double-sided image can be formed.

If an image on an odd page is formed on first photoreceptor drum 21A (on the front surface of recording paper P) and an image on an even page is formed on second photoreceptor drum 21B (on the rear surface of recording paper P) in the double-sided image forming mode (hereinafter, referred also as the first double-sided image forming mode), as shown in FIG. 4(*a*), recording paper P is discharged onto tray 19B under so-called face-down status in which the image on the first page faces downward. When image formation on all pages is completed, image formation with arranged pagers becomes possible. However, a customer sometimes requires to form an image under so-called face-up status in which the image on the first page faces upward. The image forming apparatus of the present embodiment can cope with such customer's requests. Improvement in terms of handling property can also be attained. This will now be explained referring to FIG. 4 which exhibits discharging status of recording paper P schematically.

As described above, if an image is formed in the first double-sided image forming mode, aforesaid images having arranged pages under face-down statusare prepared. To the contrary, if the customer requests face-up paper discharging, in the present embodiment, an image is formed by the second double-sided image forming mode in which outputting destination of the image signal and outputting order have been modified. Namely, images on even pages are formed on first photoreceptor drum 21A (on the front surface of recording paper P), and images on odd pages are formed on second photoreceptor drum 21B (on the rear surface) (in other words, in this case, the outputting destination of the image signal is opposite to the first double-sided image forming mode). In addition, an outputting order is modified in which an image on (n)th page is not formed from the 1st and second page but formed on and from (n−1)th page. Due to this, as shown in FIG. 4(*b*), images having arranged pages can be formed while under the face-up status.

The same thing can be said for when an image is formed on a single-sided page. Namely, recording paper P discharged on tray 19B is in the face-down state. Accordingly, in the front surface image forming mode previously described, due to forming images from the first page, images having arranged pages can be easily formed (see FIG. 4(*c*)). To the contrary, in the rear surface image forming mode, recording paper P discharged on tray 19B is in the face-up state. Therefore, the outputting order of the image signal is modified in such a manner that images are formed from the (n)th page not from the first page. Due to this, as shown in FIG. 4(*d*), images having arranged -pages can be formed under the face-up status.

As described above, the present embodiment constitutes that the outputting destination and/or the outputting order for forming toner images are modified in accordance with the paper discharging status of recording paper P (either face up or face down). Accordingly, image formation having arranged pages becomes possible. Handling property is improved.

The present embodiment constitutes one in which recording papers P are discharged on tray B (the second paper discharging means) provided in the upper portion of the image forming apparatus. Therefore, recording papers P are discharged onto tray 19B with the second surface facing upward. It is also allowed to be discharged to a tray (the first paper discharging means, not illustrated) separated from tray 19B so that recording papers P are discharged in such a manner that the first surface of recording paper P faces upward for discharging in order to discharge recording paper P sent from fixing device 18 to the side of the image forming apparatus (left side in FIG. 1). In this case, in the first double-sided image forming mode, images on odd pages are formed on first photoreceptor drum 21A and images on the even pages are formed on second photoreceptor drum 21B and the outputting order of the image signal is modified in such a manner that images are respectively formed from (n)th page and (n−1)th page. Accordingly, images having arranged pages with face-up status can be formed. In this occasion, in the second double-sided image forming mode, images on even pages are formed on first photoreceptor drum 21A and images on the odd pages are formed on second photoreceptor drum 21B and outputting order of the image signal is modified in such a manner that images are respectively formed from the 1st page and the 2nd page. In this occasion, in the front surface image forming mode, images having arranged pages under face-up status can be formed, due to starting image formation from the (n)th page. In this occasion, in the rear surface image forming mode, images having arranged pages under the face-down status can be formed, due to starting image formation from the 1st page.

It is acceptable to provide tray 19B which discharges recording papers P in which the first page thereof faces upward, a tray which discharges recording papers P in which the second page of recording paper P faces upward and a switching means which switches discharging destination of recording papers P to either tray, wherein the outputting destination and/or outputting order of the image signal is modified in such a manner that page orders are arranged.

Toner image forming means 26A and 26B of the present embodiment as described above are means for forming monochrome toner images on photoreceptor drums 21A and 21B. However, not limited thereto, a means for forming color toner image is also possible. In this occasion, in order to form yellow, magenta and cyan (preferably, black additionally) toner images, scorotron charger 22, exposure unit 25 and developing device 23 may at least be provided for each color. In addition, it is allowed that, in the image forming apparatus, processing units 20A and 20B are provided for each color and toner images formed in each process are superposed on intermediate transfer body 10 or recording paper P for forming color toner images while color toner image is not formed by superposing toner images on photoreceptor drums 21A and 21B.

Due to constitutions of above embodiments, an extremely useful image forming apparatus in terms of practical use, in which the speed for forming double-sided images is extremely increased, maintenance property is excellent, manual paper feeding is possible and the conveyance distance of the recording sheet is so short that dangerousness of the occurrence of the problem is minimized can be provided.

Further, the above-mentioned image forming apparatus can synthesize images having the same color or different colors from each other. Furthermore, image formation on a single-sided surface and double-sided surface can arbitrarily or automatically be switched. Accordingly, multiple and excellent functions can be provided.

What is claimed is:

1. An apparatus for forming a toner image on a sheet, comprising:

a first process unit comprising a photoreceptor, a charging device, an imagewise exposing device, and a developing device, whereby the first process unit forms a first toner image on the photoreceptor;

a rotatable intermediate transfer member having a toner image receiving surface, wherein the first process unit is located in close proximity to the toner image receiving surface of the rotatable intermediate transfer member;

a second process unit comprising a photoreceptor, a charging device, an imagewise exposing device, and a developing device, whereby the second process unit forms a second toner image on the photoreceptor thereof, and wherein the second process unit is located in close proximity to the toner image receiving surface;

a second transfer device for transferring the second toner image from the second process unit to the toner image receiving surface;

a sheet feeder for feeding a sheet to the toner image receiving surface so that a second side of the sheet is provided with the second toner image; and a first transfer device for transferring the first toner image from the first process unit to a first side of the sheet on the toner image receiving surface.

2. The apparatus of claim 1, further comprising:

a third transfer device for transferring the second toner image from the toner image receiving surface to the second side of the sheet.

3. The apparatus of claim 2, wherein the third transfer device transfers the second toner image after the first transfer device transfers the first toner image from the first process unit to the first side of the sheet.

4. The apparatus of claim 2, further comprising:

a sheet charging device for electrically charging the sheet on the basis of a sheet charging condition for the sheet, wherein each of the first, second and third transfer devices has a transfer condition on which the toner image is transferred, and wherein at least two of transfer conditions of the first, second and third transfer devices, and the sheet charging condition of the sheet charging device are changed in accordance with a change in the kind of sheet or environmental condition.

5. The apparatus of claim 2, further comprising:

a sheet charging device for electrically charging the sheet on the basis of a sheet charging condition for the sheet, and a separating device to separate the sheet from the rotatable intermediate transfer member on the basis of a sheet separating condition for the sheet, wherein each of the first, second and third transfer devices has a transfer condition on which the toner image is transferred, and wherein at least two of transfer conditions of the first, second and third transfer devices, and the sheet charging condition of the sheet charging device and the sheet separating condition of the separating device are changed in accordance with a change in the kind of sheet or environmental condition.

6. The apparatus of claim 2, wherein each of the first, second and third transfer devices has a transfer condition on which the toner image is transferred, and the transfer conditions among the first, second and third transfer devices are different from each other.

7. The apparatus of claim 6, wherein:

the transfer condition includes a transfer current and a transfer voltage, the absolute value of either the transfer current or the transfer voltage in the first transfer device is larger than that in the second transfer device, and the absolute value of either the transfer current or the transfer voltage in the third transfer device is larger than that in the first transfer device.

8. The apparatus of claim 1, further comprising:

a sheet charging device for electrically charging the sheet so that the sheet is electrically attracted to the rotatable intermediate transfer member.

9. The apparatus of claim 1, wherein the first and second process unit are located serially in the rotating direction of the image surface and on the image surface, and wherein the sheet feeder feeds the sheet between the first and second process units.

10. The apparatus of claim 1, wherein the sheet feeder comprises:

a sheet cassette located beneath the rotatable intermediate transfer member; and a sheet passage to guide the sheet so as to proceed over the second process unit and to proceed downward to the toner image receiving surface.

11. The apparatus of claim 1, wherein:

each of the first process unit and the second process unit has a respective toner image forming condition including a charging condition of the charging device, an imagewise exposing condition of the imagewise-exposing device, and a developing condition of the developing device; and the toner image forming condition of the second process unit is different from that of the first process unit.

12. The apparatus of claim 11, wherein the toner image forming condition of the first process unit and the toner image forming condition of the second process unit differ in at least one of the charging condition, the imagewise exposing condition, and the developing condition.

13. The apparatus of claim 11, wherein:

each of the first process unit and the second process unit comprises an image signal processor to process image signals based on which the imagewise exposing device conducts imagewise exposure on the photoreceptor;

each of the toner image forming condition of the first process unit and the toner image forming condition of the second process unit further includes an image signal processing condition of the image signal processor; and the toner image forming condition of the first process unit and the toner image forming condition of the second process unit differ in the image signal processing condition.

* * * * *